US008210485B2

(12) United States Patent
Scobey, Jr.

(10) Patent No.: US 8,210,485 B2
(45) Date of Patent: Jul. 3, 2012

(54) TRASH BAG APPARATUS AND METHOD OF USE

(76) Inventor: Fred Bradley Scobey, Jr., Reno, NV (US)

( * ) Notice: Subject to any disclaimer, the term of this patent is extended or adjusted under 35 U.S.C. 154(b) by 0 days.

(21) Appl. No.: 12/723,599

(22) Filed: Mar. 12, 2010

(65) Prior Publication Data

US 2010/0230554 A1 Sep. 16, 2010

Related U.S. Application Data

(60) Provisional application No. 61/159,794, filed on Mar. 12, 2009.

(51) Int. Cl.
*B65B 67/04* (2006.01)

(52) U.S. Cl. ..... 248/99; 248/97; 248/907

(58) Field of Classification Search ..... 248/95, 248/97, 99, 101, 907
See application file for complete search history.

(56) References Cited

U.S. PATENT DOCUMENTS

| | | | | | |
|---|---|---|---|---|---|
| 1,121,388 | A | * | 12/1914 | Milks | 248/95 |
| 1,351,772 | A | * | 9/1920 | Libbey | 24/483 |
| 1,502,597 | A | * | 7/1924 | Taylor | 248/97 |
| 3,532,314 | A | * | 10/1970 | Vosbikian | 248/97 |
| 4,037,778 | A | | 7/1977 | Bayle | |
| 4,319,726 | A | * | 3/1982 | Andersson | 248/97 |
| 4,846,427 | A | * | 7/1989 | Jones | 248/95 |
| 5,139,219 | A | * | 8/1992 | Navarro | 248/97 |
| 5,433,406 | A | * | 7/1995 | Chavez | 248/99 |
| 5,588,622 | A | * | 12/1996 | Gordon, Sr. | 248/101 |
| 5,899,419 | A | * | 5/1999 | Ross et al. | 248/97 |
| 6,030,010 | A | | 2/2000 | Graeff | |
| 6,367,822 | B1 | * | 4/2002 | Hutchins | 280/47.24 |
| 6,494,619 | B1 | | 12/2002 | Sulpizio | |
| 6,543,732 | B1 | * | 4/2003 | Yuan | 248/99 |
| 6,648,386 | B2 | | 11/2003 | Rheinhardt | |
| 6,676,092 | B2 | * | 1/2004 | Tsai | 248/97 |
| 7,066,220 | B1 | | 6/2006 | Take et al. | |
| 7,350,547 | B2 | | 4/2008 | Quiring | |
| 7,461,821 | B2 | * | 12/2008 | Cheng | 248/99 |
| 7,753,322 | B1 | * | 7/2010 | Peterson | 248/99 |
| 2009/0014603 | A1 | * | 1/2009 | Zima | 248/101 |

* cited by examiner

*Primary Examiner* — Bradley Duckworth
(74) *Attorney, Agent, or Firm* — Colin P. Abrahams

(57) ABSTRACT

One possible embodiment of the invention could be a trash bag holder and methodology of operating same, the trash bag holder comprises a resilient strip that is looped to adjustably form a hoop of an desired circumference; a catch mechanism that reversibly fixes the hoop at the desired circumference; a handle with two ends, a first end being pivotally attached to at least a portion of the hoop; wherein the hoop retains and holds open an open mouth portion of a trash bag placed upon the hoop by adjusting the circumference of the hoop to at least meet the circumference of the open mouth portion of the trash bag. The holder may further comprise a base reversibly attached to the handle to respectively orient the hoop parallel to and the handle perpendicular to the ground. The hoop may further encapsulate the base edge in a compact state.

12 Claims, 5 Drawing Sheets

TRASH BAG APPARATUS AND METHOD OF USE

CROSS-REFERENCES TO RELATED APPLICATIONS

This application claims the benefit under 35 U.S.C. §119 (e) of U.S. Provisional Patent Application No. 61/159,794, filed on Mar. 12, 2009, the contents of which are relied upon and incorporated by reference.

STATEMENT REGARDING FEDERALLY SPONSORED RESEARCH OR DEVELOPMENT

Not Applicable.

REFERENCE TO A "MICROFICHE APPENDIX"

Not Applicable.

FIELD OF THE INVENTION

The present invention relates to those apparatuses that may be used to hold open a trash bag in various orientations to permit the depositing of materials into the bag under a wide variety of circumstances.

BACKGROUND

During yard maintenance, especially by a homeowner of a residential property, the use of trash bags in the collecting material (e.g., refuse, debris, discarded items, and the like from the yard area) can be difficult in that one person generally tries to hold open the trash bag while simultaneously operating cleaning implements (such a rake, broom, and the like) to try to load the trash bag with the material collected from the yard. As a result, less-coordinated persons could have a hard and frustrating time trying to keep the trash bag open (generally considered a two-handed operation under the best of circumstances) while attempting to load the bag with refuse and other debris type material in conjunction with the operation of the cleaning implement.

This situation also appears in other environments where bags need to be held open to receive materials. Such examples can include trash bags used to hold recyclables (e.g., garage); bags that receive dirty clothes, linen, and alike (bedroom closet); and trash bags under a sink used to hold garbage and the like (kitchen).

What is needed therefore is an apparatus that can reversely, yet securely, attach to a trash bag; hold the trash bag open; and position the trash bag to receive material (e.g., debris and the like). In one manner, the apparatus could be used to orient the trash bag to generally place the open-mouth of the trash bag proximate to the ground to ease the entry of materials from the ground into the trash bag as well as generally have the ability to generally orient the bag with its open month held upright to receive materials being dropped into it. The apparatus could also be so constructed to have a small footprint when put into a compact state for storage.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to hold open a mouth of a trash bag in either a vertical or horizontal orientation to allow the operator to place materials into the trash bag in an either vertical/parallel or horizontal/perpendicular orientation to the ground;

provide a trash bag holder with an hoop having an adjustable diameter further featuring a roughened edge that reversibly yet securely attaches to a trash bag to hold the trash bag open;

the ability to secure the hoop around the edge of the base when the invention is stored;

provide a trash bag holder that can accommodate a wide variety of trash bags of different lengths and set circumferences/diameters;

the ability to allow a trash bag holder telescope to accommodate trash bags of varying length set in horizontal/perpendicular orientation to the ground;

and provide a trash bag holder that can be placed into a compact state with comparatively small footprint for ease of storage.

These and other advantages may be realized by reference to the remaining portions of the specification, claims, and abstract.

BRIEF DESCRIPTION OF ONE EMBODIMENT OF THE PRESENT INVENTION

One possible embodiment of the invention could be a trash bag holder comprises a strip of resilient material, having definite length and width, terminating in two strip ends, one strip end is looped relative to the other end to adjustably form a hoop of an desired circumference; a catch mechanism that reversibly fixes the hoop at the desired circumference; a handle with two handle ends, a first handle end being pivotally attached to at least a portion of the hoop; wherein the hoop retains and holds open an open-mouth portion of a trash bag placed upon the hoop by adjusting the desired circumference of the hoop to at least meet the circumference of the open-mouth portion of the trash bag.

Another version of the invention could be a method of operating a trash bag holder, comprising of the following steps, but not necessarily in the order shown; providing a trash bag holder having an hoop with an adjustable desired circumference, the hoop pivotally connected to one end of a two-ended handle; providing a first trash bag with an open-mouth portion having a set circumference; placing the open-mouth portion over the hoop; and reversibly adjusting the desired circumference of the hoop to receive to at least reversibly meet the set circumference of the trash bag. Another version of the invention could be a trash bag holder comprising of an adjustable circumference hoop means snugly engaging and holding open the mouth portion of a trash bag; a telescopic support means for placing hoop means into a desired height; and a base means for holding the telescopic support means into a vertical position.

The above-description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
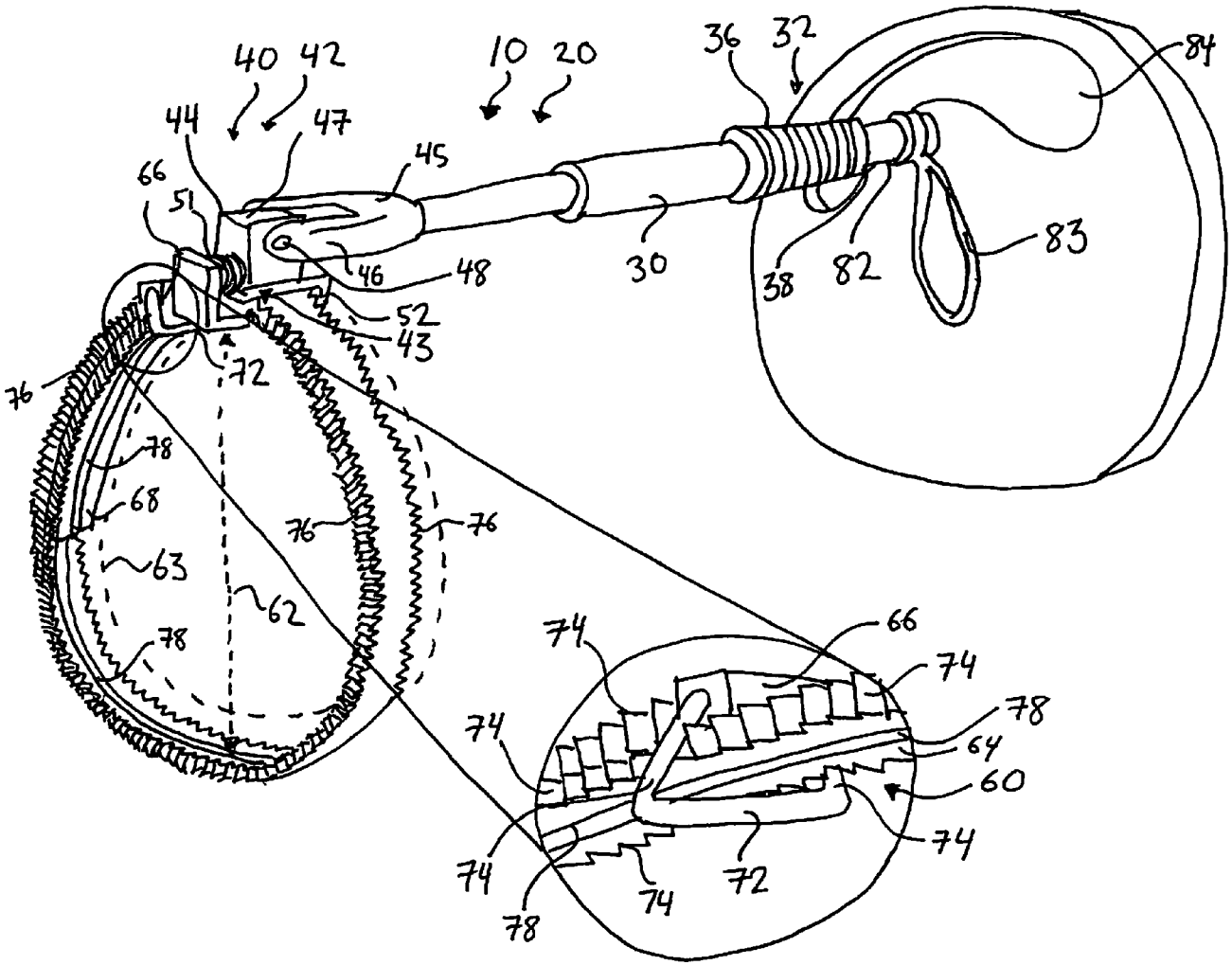
FIG. 1 is substantially a perspective view of one embodiment of present invention.
Figure 2:
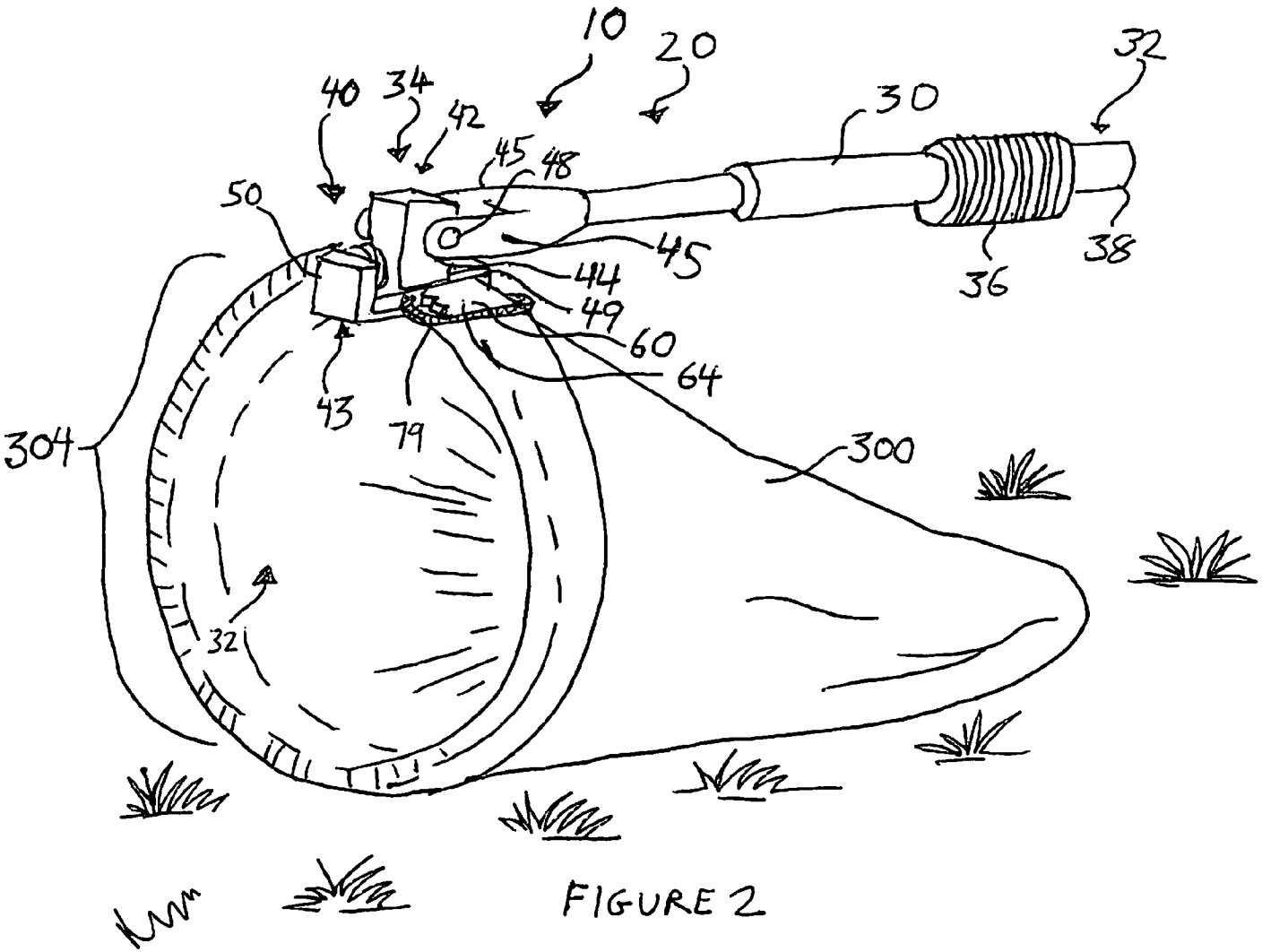
FIG. 2 is substantially a perspective view of one embodiment of present invention in a horizontal operation orientation.

The present invention 10 could comprise of a trash bag holder 20 and a methodology or process 200 of storing the trash bag holder 20. As substantially shown in FIGS. 1 and 2, the trash bag holder 20 could comprise of hoop 60, a telescopic handle 30 and a base 80.

The hoop 60 could be comprised of a strip 64 made of resilient material having a definite length and width with two strip ends 49, 50. The hoop 60 could be formed with an adjustable desired diameter 62 (e.g., adjustable desired circumference 63) when a first strip end 49 is looped relative to a portion of the strip 64 and is adjustably held in place proximate to portion of the strip 64 by a catch mechanism 70. A variety of adjustable locking apparatuses and devices as known to those skilled in the art may be used as the catch mechanism 70 and still be considered as part of the invention 10. In at least one embodiment, the catch mechanism 70 could comprise the first strip end 66 having movably attached loop 72 through whose interior is movably passed the second strip end 68. The frictional contact of the edges 76 of the second strip end 68 against the sides 74 of the loop 72 could generally adjustably hold the strip 64 into the desired hoop form and at the desired diameter 62/circumference 63. Once such an insertion has taken place, the respective strip ends 66, 68 could be moved closer together or further apart relative to one another to respectively reduce or increase the size of the diameter 62/circumference 63 of the hoop 60. To further aid in the retention (during operation) of the selected diameter size, the strip 64 could roughen (e.g., serrated) along its lengthwise edges 76.

In at least one embodiment, the loop 72 could be formed to be have canted sides. In one version where the second end is passed against the underside of the first end so that the normal resiliency of the strip presses the second end against underside of the first end, the loop could be wider or canted outward at where it attaches to the first strip end 66 and narrower or canted inward at the end that is not attached to the first strip end. In this manner, so that when the second strip end 68 is inserted and passed through the loop 72, the natural tendency of the hoop 60 to uncoil/unloop and straighten out could cause a portion of the inserted strip 64 passing through the loop 72 to press up and against the narrow section of the loop 72 formed by its canted sides 74. As such, the normal resiliency of the strip 64 could further cause the serrated edges 76 to engage the sides 74 of the loop 72 to generally prevent the change in diameter 62 of the hoop 60 until the operator presses the second strip end portion 68 of the strip 64 towards wider end of the loop 72 to generally allowing the serrated edges to avoid engagement of the sides 74 of the loop 72 and allowing the loop inserted portion of the strip 64 to substantially and freely pass though the loop 72 in manner that generally adjusts the hoop's diameter 62.

In at least one embodiment, the serrated edge 76 could also be used to further impart to the hoop 60 an enhanced trash bag holding/retention capability to generally prevent the weight of materials placed into the trash bag 300 from prematurely pulling the trash bag 300 off of the hoop 60. The serrated edge 76 could catch in frictional manner (e.g., reversibly snare) the surface of the trash bag's sides as the open-mouth/open end portion 302 of the trash bag 300 is engaged by hoop 60 as the trash bag 300 is suitably mounted upon the trash bag holder 20.

The hoop 60 could be constructed to allow its diameter to be adjusted to handle a number of trash bags 300 whose open-mouth portions 302 have a wide variety of trash bag set circumferences 304.

For this invention 10, its should be noted that the trash bag 300 refers to a wide of bags (e.g., garbage bags, lawn bags, construction bags and like) having a body with a set circumference/diameter 304, two ends, one end being closed and one end being open (i.e., an open-mouth portion 302) to connect an exterior to a generally hollow interior that can receive objects such lawn refuse, garbage, construction debris, and the like. It should also be noted that such bags 300 may have a fixed maximum circumference for their open-mouth portions 302 or they could be of the drawstring variety of bags wherein they have an adjustable circumference for their open-mouth portions 302. In either case, the set circumference 304 of the bag 300 could generally be either the fixed maximum circumference of the bag 300 or the smaller circumference of the bag obtained/adjusted (e.g., by pulling on the bag's drawstrings) by the operator (not shown) for the invention 10.

The telescopic handle 30 could have two handle ends 32, 34, a first handle end 32 having a grip 36 and a handle attachment point 38 that reversibly attaches to a reciprocal base attachment point 82 on the base 80, the other second handle end 34 being pivotally-attached to a hoop attachment device 40 that can grip at least a portion of the hoop 60. In at least one embodiment, the hoop attachment device 40 could have two parts, a pivot attachment 42 and a clasp 43. The pivot attachment 42 could have a male portion 44 and female portion 45 wherein the female portion 45 attached to the telescopic handle further features between which the male base 47 of the male portion 44 is placed. An axle 48 (placed perpendicularity through the arms 46 and respectively through the male base 47) movably connects the male portion 44 to female portion 45 to generally allow the male portion 44 to pivot about the axle 48. Striations (not shown) on the inside of the arms 46 and on the male base 47, could come into contact with one another respectively to generally hold the position of the male portion 44 relative to the pair of arms 46 as set by the operator (not shown). In at least one embodiment, the clasp portion of the hoop attachment point 40 may also reversibly fix the hoop 60 at the desired circumference 63/diameter 62.

The telescopic handle 30 could have two handle ends 32, 34, a first handle end 32 having a grip 36 and a handle attachment point 38 that reversibly attaches to a reciprocal base attachment point 82 on the base 80, the other second handle end 34 being pivotally-attached to a hoop attachment device 40 that can grip at least a portion of the hoop 60. In at least one embodiment, the hoop attachment device 40 could have two parts, a pivot attachment 42 and a clasp 43. The pivot attachment 42 could have a male portion 44 and female portion 45 wherein the female portion 45 attached to the telescopic handle further features between which the male base 47 of the male portion 44 is placed. An axle 48 (placed perpendicularity through the arms 46 and respectively through the male base 47) movably connects the male portion 44 to female portion 45 to generally allow the male portion 44 to pivot about the axle 48. Striations (not shown) on the inside of the arms 46 and on the male base 47, could come into contact with one another respectively to generally hold the position of the male portion 44 relative to the pair of arms 46 as set by the operator (not shown). In at least one embodiment, the clasp 43 of the hoop attachment device 40 may also reversibly fix the hoop 60 at the desired circumference 63/diameter 62.

First handle end 32 could have a suitable grip 36 to allow positive grasping of the telescopic handle 30 by hand of an operator (not shown). The handle attachment point 38, in at least one possible embodiment, could be a concave opening 54 at the tip of the first handle end 32. This concave opening 54 could be so designed to firmly, yet reversibly, hold within it the base attachment point 82 to attach the base 80 to the telescopic handle 30. The overall telescopic handle 30 should be so constructed to allow its length to be adjusted to allow the invention 10 to handle trash bags 300 having a wide variety of lengths.

The base 80 could be made of any suitable material known to those skilled in the art that is formed into a disk-shape with the base attachment point 82 located at an edge of the base. The base 80 should be a sufficient diameter and weight to properly act as an anchor holding the combination of telescopic handle/hoop/garbage bag in a upright manner so that invention 10 with trash bag 300 remains in that orientation despite the weight of materials placed in the trash bag 300 attempting to remove the combination from such orientation.

Figure 3:
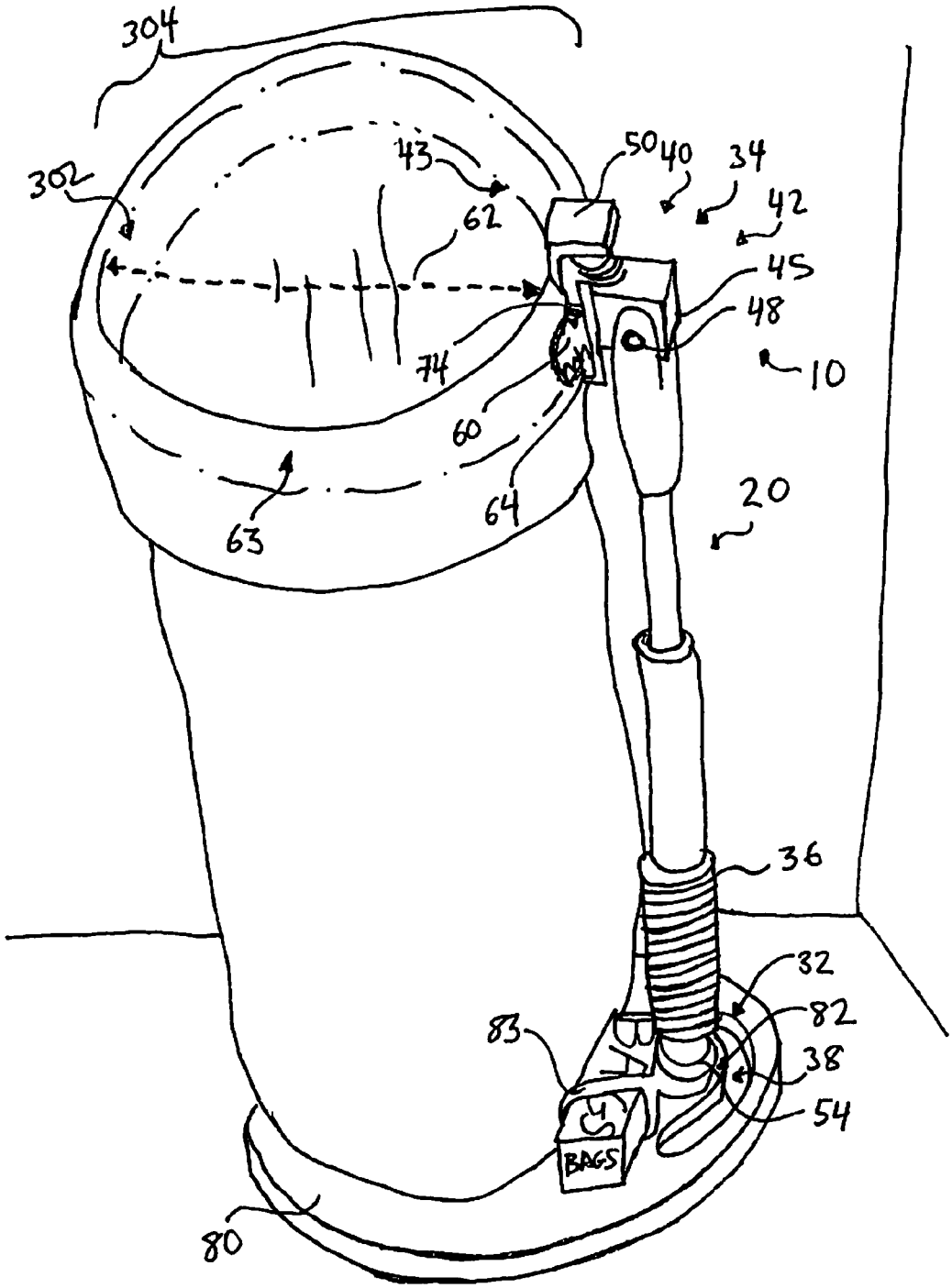
FIG. 3 is substantially a perspective view of one embodiment of the present invention in a vertical operation orientation.
Figure 4:
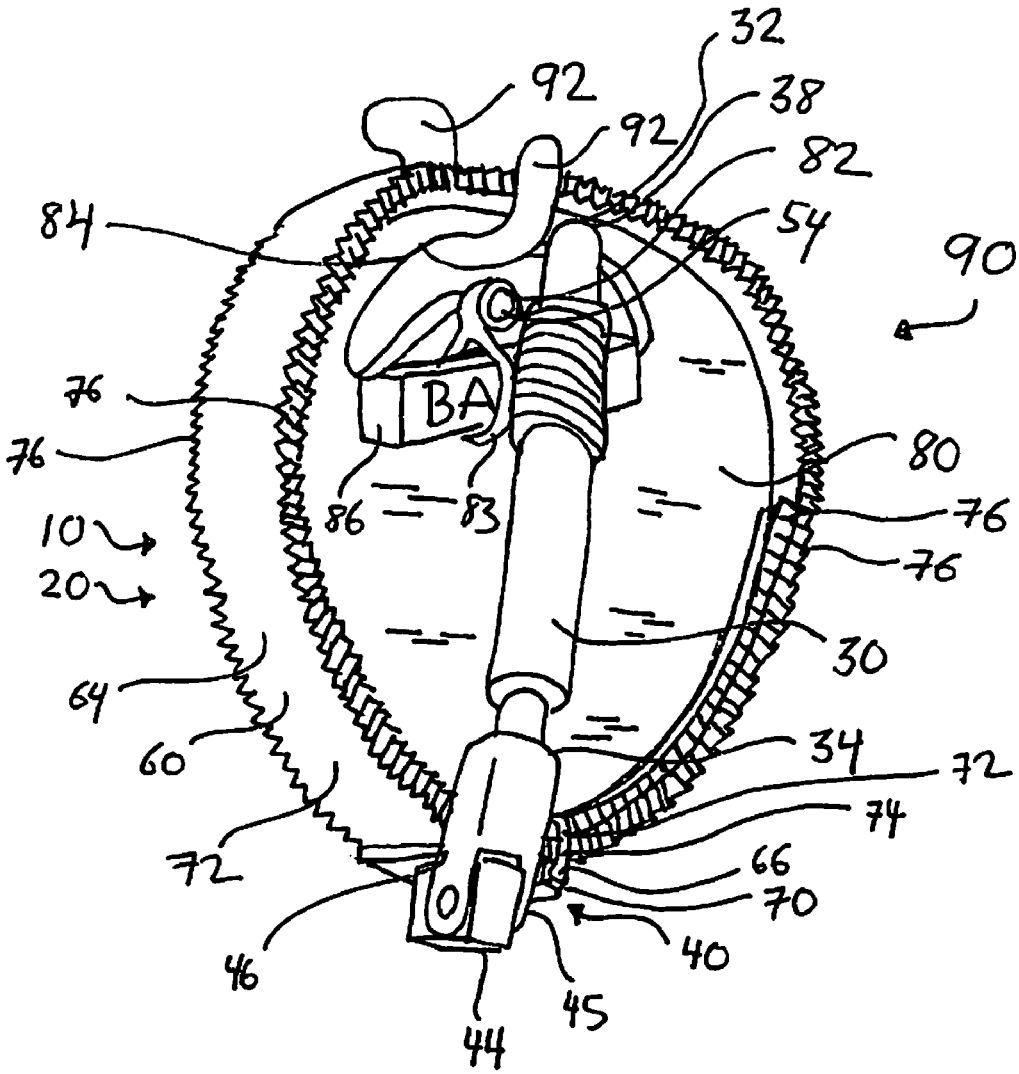
FIG. 4 is substantially a perspective view of one embodiment of the present invention stored in a compact state.

As substantially shown in FIG. 3, at least one embodiment, the base 80 could feature a cutout 84, base attachment point 82, and a lanyard 83. The cutout 84 could be located near the edge of the base 80 and appropriately sized to allow the user (not shown) to place a portion of its hand into the cutout 84 to comfortably grasp the base for transport. The cutout 84 could also be shaped to allow partial passage of a wall-mounted hook 92 to allow the invention 10 when placed in a compacted state to be hung on the wall 90.

Proximate to the cutout 84 could be the base attachment point 82, which could be designed as to be reversibly but snugly received with in the concave opening 54 of the handle attachment point 38 so as to substantially impart a friction fit relationship between the two attachment points 38, 82. Movably attached to the base attachment point 82 could an elastic looped lanyard 83 in an appropriate manner to the base attachment point 82 to allow the lanyard 83 to swivel around the base attachment point 82. The loop 87 of the lanyard 83 could be designed to reversibly yet securely accept a trash bag container 86 for ease of replenishing trash bag 300.

In at least one embodiment of the strip 64, the strip 64 could have along its longitudinal axis of its inner side a channel 78 that could receive an edge of the base 80 when the base 80 is placed with the hoop 60 for storage and the diameter 62 of the hoop 60 is adjusted to close the channel 78 upon the edge of the base 80 to generally retain the base 80 within the hoop 60.

The invention 10 could be used in at least two (2) operating modes and at least one storage mode. The operating modes could comprise: a) horizontal operating mode-without the base-to hold the open portion of the bag proximate to the ground and b) a vertical operating mode, using the base, to hold the open-mouth portion of the trash base upright and generally away from the ground. In the both operating modes, the operator of the invention selects which trash bag (e.g., based on bag length, open-mouth portion radius/diameter/circumference, and other suitable factors). After selecting the trash bag, the operator brings the top portion of the trash bag through the interior of the hoop and drapes the top portion over the outer circumference of the hoop. The operator could then adjust the diameter/circumference of the hoop by moving the strip ends of the hoop closer or away from one another so that the desired circumference of the hoop closely matches the circumference of open-mouth portion of the trash bag so as to hold the bag upon the loop and allowing the loop to hold open the bag. Further, the roughened edge of the strip/hoop can reversibly engage material (e.g., sides) of the trash bag to further resist the force exerted by weight of any material placed in the bag that may cause the bag to slip off the hoop during operation.

The operator can then appropriately manipulate the clasp (e.g., open the L-shaped clamps far enough apart) to allow the clasp to receive the hoop. In at least one embodiment, the clasp engages hoop with the bag draped over the hoop (e.g., the clasp grips portions of both the hoop and the trash bag). In another embodiment, the clasp could only receive the hoop with an open-mouth portion of the trash bag being draped over the clasp as well. The operator can then allow the biasing mechanism of the clasp to close its clamps upon the hoop/portions of the bag to lock the hoop within the clasp and thus attach hoop to the telescopic handle. In this manner as well the clasp and hence hoop attachment device can also be seen as reversibly fixing the circumference of the hoop.

In the horizontal operating mode, the operator may further adjust the handle length and pivot the clasp to place the telescopic handle a suitable length as well as proper angle to the ground relationship to allow the operator to comfortably hold the bag with its open month proximate to the ground with one hand. In the other hand, the operator may operate a suitable collection implement (e.g., broom, brush, rake, shovel and the like—not shown) to collect material, objects and alike on the ground and to drive such collected material into the open-mouth portion of the trash bag and on through to the interior of the trash bag while holding the trash bag in a generally horizontal/parallel position to the ground (e.g., the open-mouth portion is held proximate to the ground.) The operator, using the handle, can press down on the hoop so that the bottom portion of the hoop can contact the ground to generally deform the hoop into an oval shape. In this manner, the bottom portion of the hoop has greater conformity with the surface of the ground to make it easier to brush/rake in material from the ground into the trash bag.

In the vertical operating mode, the operator may attach the telescopic handle to the base. The operator may then adjust the telescopic handle length to generally accommodate the remaining length of the trash bag after the bag has been attached to the hoop. The operator may further pivot the clasp to place the hoop in a parallel planar relationship to the base so the trash bag is generally in a vertical orientation with the mouth of the trash bag generally away from the ground. The operator then can use a multiple loop lanyard rotatably attached to the base attachment point to hold one or trash bag containers proximate to the base for convenience in replenishing the invention with fresh bags. By using different size/use trash bags, the invention can be adjusted to hold a wide variety of trash bags in a generally upright position is areas from underneath a sink (e.g., kitchen trash disposal) to the garage (e.g., recyclable usage storage) to outdoors (yard refuse collection), to the bedroom closet (dirty laundry collection).

When the operator wants to replace/replenish the trash bag, depending on the way the clasp was placed on the hoop could unclasp the hoop/bag (if the clasp is not gripping the bag as well as the hoop, the clasp could be left alone), the operator could make the hoop circumference/diameter smaller/narrower and remove the trash bag from the hoop. A new trash bag could be drawn (e.g., the open-mouth portion) through the hoop interior and draped back over the hoop, the desired hoop circumference is adjusted to meet the set circumference of the selected trash bag. If so desired, the clasp could be applied to the hoop to grasp portions of both the trash bag and the hoop.

Figure 5:
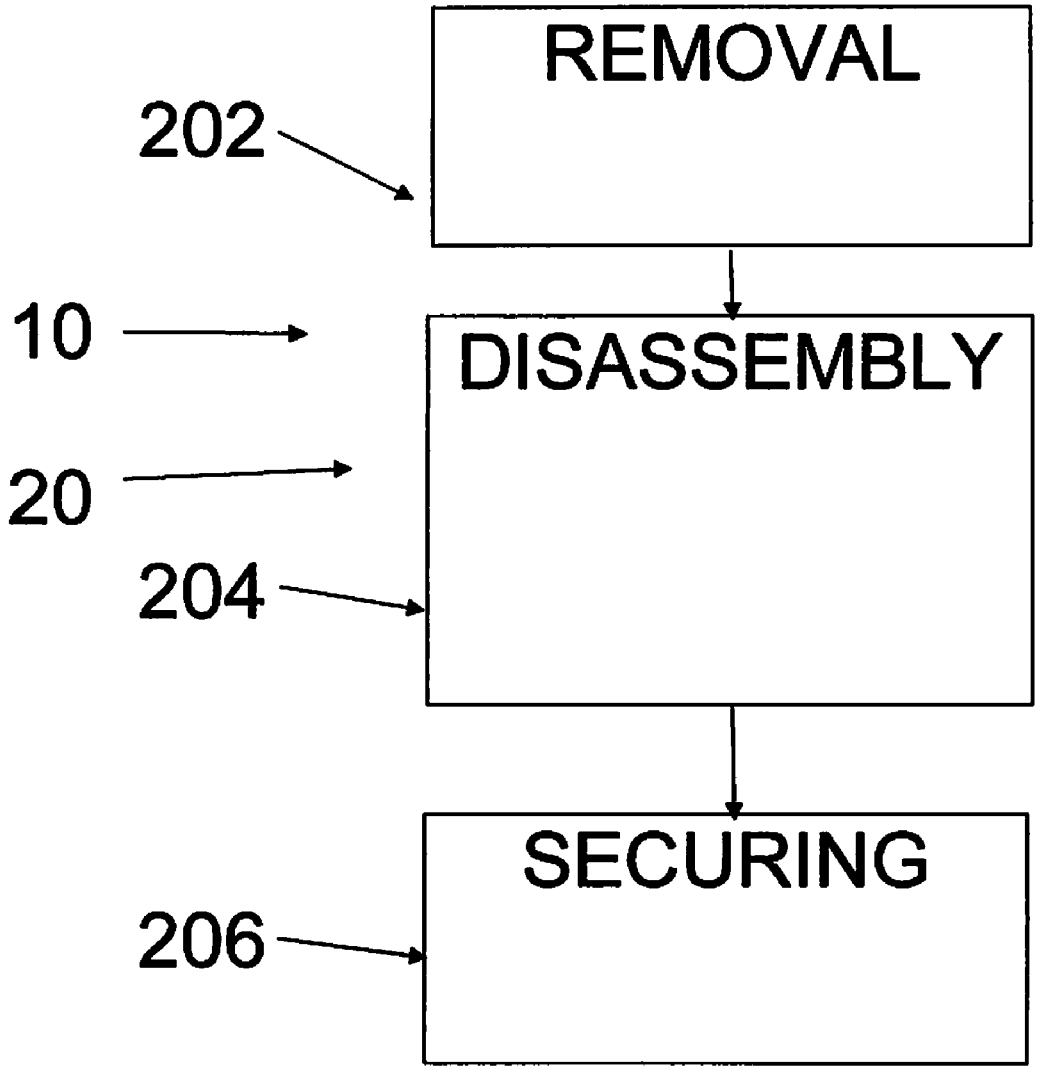
FIG. 5 is substantially a flow chart demonstrating at least one process for operating the invention.

As substantially shown in FIG. 5, when the operator (not shown) is through using the trash bag holder 20 and wishes to place it in a compact state for storage, the operator could use the process of compacting and storing the invention 200. The step 200 trash bag removal, in this process 200 could start with the removal of the trash bag from the hoop as described in detail above. Once that is completed, the process 200 could generally proceed to step 204, disassembly, In step 204, disassembly, if the apparatus is used in the vertical operating mode, the operator could disconnect the base from the telescopic handle. The operator can manipulate and pivot the clasp to place the telescopic handle over the hoop. Once this step 204 is substantially completed, the process 200 could generally proceed to step 206, securing the base.

In step 206, securing the base, the operator could place the base within the interior of the hoop and by adjusting the hoop's desired circumference (e.g., opening the clasp and adjusting the placement of the strip edges to one another) to allow the interior side of the hoop to generally contract and impinge its channel upon the edge of the base to securely hold the base within the interior of the hoop. If so desired, containers of trash bags could be placed within and be held by an elastic lanyard with the hoop interior proximate to the base. In this manner, the apparatus and bag supply could be compacted into a generally flat and small footprint for storage. The operator could place its hand in the cutout to carry the compacted apparatus. Similarly, a wall-mounted hook could protrude through the cutout to hold the invention in place on the hook. The compacted invention could be placed back into operating condition by generally reversing the steps as discussed above.

CONCLUSION

As described above the present invention provides a means of holding open trash bags with an circumference-adjustable hoop and placing the trash bag in either a hand-held horizontal/parallel orientation to the ground (e.g., open-mouth portion of the bag proximate to the ground) for scooping in material from the ground or in a stand-alone vertical orientation/perpendicular to the ground (open-mouth portion of the trash bag is away from the ground) for dropping material into the trash bag. The apparatus can be arranged into a compact state having a small and flat footprint for easy transport and convenient storage when not in use.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A trash bag holder comprising a elongate resilient strip having an outer surface and an inner surface, a first end and a second end, and an upper edge and a lower edge, the elongate resilient strip being configured into a closed substantially circular hoop in which the first and second ends of the resilient strip selectively slide over the outer surface and inner surface respectively so that the circular hoop can have a variable diameter, the upper edge and lower edge having serrations along the entire lengths thereof;

a loop at or near the first or second end of the resilient strip to receive the second or first end of the resilient strip and a portion of the resilient strip to maintain the resilient strip in the substantially circular hoop configuration; and a handle having a holding end and a gripping end, the gripping end being releasably attached to the circular hoop at any point along its circumference.

2. A trash bag holder as claimed in claim 1 further comprising a base.

3. The trash bag holder of claim 2 wherein the base provides storage for trash bags to be used by the invention.

4. A trash bag holder as claimed in claim 2 wherein the base is generally circular in shape.

5. A trash bag holder as claimed in claim 1 wherein the base comprises a receiving slot for receiving and holding the handle in a generally vertical orientation.

6. A trash bag holder as claimed in claim 1 wherein the handle comprises a clamp at the gripping end which is movable between a closed position whereby it attaches to the circular hoop and an open position whereby the circular hoop can be separated from the handle.

7. A trash bag holder as claimed in claim 1 wherein the serrations are configured to engage a plastic trash bag.

8. A trash bag holder as claimed in claim 1 wherein the circumference of the circular hoop is adjustable to hold a trash bag at an open mouth thereof by selectively moving the first and second ends along the resilient strip until the desired circumference is achieved.

9. A trash bag holder as claimed in claim 1 wherein the loop permits slidable movement of the first and second ends.

10. A trash bag holder as claimed in claim 1 wherein the resilient strip can be configured into the circular loop to the extent that the circular loop comprises a double resilient strip along almost its entire circumference.

11. A trash bag holder as claimed in claim 1 wherein the serrations are continuous along the edges.

12. A trash bag holder comprising:

an elongate resilient strip having an outer surface and an inner surface, a first end and a second end, and an upper edge and a lower edge, the elongate resilient strip being configured into a closed substantially circular hoop in which the first and second ends of the resilient strip selectively slide over the outer surface and inner surface respectively so that the circular hoop can have a variable diameter, the upper edge having serrations along the entire length thereof;

a loop at or near the first or second end of the resilient strip to receive the second or first end of the resilient strip and a portion of the resilient strip to maintain the resilient strip in the substantially circular hoop configuration; and a handle having a holding end and a gripping end, the gripping end being releasably attached to the circular hoop at any point along its circumference.

* * * * *